US008303373B2

(12) United States Patent
Kozasa

(10) Patent No.: US 8,303,373 B2
(45) Date of Patent: Nov. 6, 2012

(54) SLURRY SUPPLYING APPARATUS AND METHOD OF POLISHING SEMICONDUCTOR WAFER UTILIZING SAME

(75) Inventor: Kazuaki Kozasa, Nagasaki (JP)

(73) Assignee: Sumco Techxiv Corporation, Nagasaki (JP)

( * ) Notice: Subject to any disclaimer, the term of this patent is extended or adjusted under 35 U.S.C. 154(b) by 606 days.

(21) Appl. No.: 12/471,102

(22) Filed: May 22, 2009

(65) Prior Publication Data

US 2009/0298393 A1 Dec. 3, 2009

(30) Foreign Application Priority Data

May 30, 2008 (JP) ..... 2008-143780

(51) Int. Cl.
*B24B 1/00* (2006.01)

(52) U.S. Cl. ..... 451/41; 451/60; 451/57

(58) Field of Classification Search ..... 451/41, 451/60, 446, 447
See application file for complete search history.

(56) References Cited

U.S. PATENT DOCUMENTS 6,053,802 A * 4/2000 Yi et al. ..... 451/60
6,338,671 B1 * 1/2002 Kawashima et al. ..... 451/87
6,348,076 B1 * 2/2002 Canaperi et al. ..... 51/309
6,406,364 B1 * 6/2002 Kimura et al. ..... 451/446
6,457,852 B1 * 10/2002 Hiraoka et al. ..... 366/136
2008/0096475 A1 * 4/2008 Yoshida ..... 451/60
2009/0053981 A1 * 2/2009 Kozasa et al. ..... 451/447

FOREIGN PATENT DOCUMENTS

JP 2002-170793 6/2002
JP 2002-331456 11/2002
JP 2004-063858 2/2004
JP 2004-075859 3/2004
JP 2004-266155 9/2004

* cited by examiner

*Primary Examiner* — Dung Van Nguyen
(74) *Attorney, Agent, or Firm* — Alston & Bird LLP

(57) ABSTRACT

A diluted slurry supplying apparatus utilized in a polishing apparatus for finishing a semiconductor wafer with a slurry containing colloidal silica and water-soluble polymer is provided. The polishing method comprises: a slurry supplier capable of supplying the slurry containing the colloidal silica and the water-soluble polymer; a diluent supplier capable of supplying a diluent containing an aggregation preventing agent to dilute the slurry; a mixer capable of receiving the slurry and the diluent having been supplied from the slurry supplier and the diluent supplier, respectively, the mixer forming a diluted slurry with a pH value of at least 9; and an ultrasonic vibrator capable of applying an ultrasonic vibration to the diluted slurry staying in the mixer or being fed out from the mixer. Here, the diluent supplying apparatus can change a dilution proportion of the diluted slurry.

5 Claims, 5 Drawing Sheets

SLURRY SUPPLYING APPARATUS AND METHOD OF POLISHING SEMICONDUCTOR WAFER UTILIZING SAME

CROSS REFERENCE TO RELATED APPLICATIONS

This application is based upon and claims the benefits of priority from Japanese Patent Application No. 2008-143780 filed on May 30, 2008, the entire contents of which are incorporated herein by reference.

FIELD OF THE INVENTION

The present invention relates to a slurry supplying apparatus and a method of polishing a semiconductor wafer utilizing the apparatus. More specifically, the present invention relates to a slurry supplying apparatus that supplies a slurry containing colloidal silica and relates to a method of polishing a semiconductor wafer utilizing the apparatus.

BACKGROUND

In general, a semiconductor wafer is subject to a rough polishing (primary polishing), then a finish polishing (secondary polishing), and thereafter a device processing. The finish polishing is performed using a slurry that contains colloidal silica to obtain an ultramicroscopic surface roughness on the surface. The contained colloidal silica is extremely small to have a diameter of several tens nm by the spherical approximation. Since such slurry containing colloidal silica is more costly, it is considered that recycled slurry or diluted slurry may be used.

Here, the colloidal silica is a compound of amorphous anhydrous silicic acid in a colloidal state and may include unmodified colloidal silica as well as modified colloidal silica, surface of which is modified with ions or compounds such as ammonia, calcium, alumina, and so on so that colloidal particles thereof have modified ionic properties and behavior in response to a pH change. The colloidal silica may also include ultrahigh purity colloidal silica prepared by a sol-gel method and may also refer to a dispersion fluid having silica particles of colloidal sizes dispersed in water or organic solvent. In general, a slurry refers to a suspension that is also called a slip or a slime and may include a mixture having minerals, sludge, and so on dispersed in liquid. The slurry may be a highly viscous (pulpy) fluid substance. In particular, the slurry may include a chemical solution containing abrasive grains used for CMP (chemical mechanical polishing) or wafer lapping.

As an example of recycling of the slurry, art to reproduce a CMP slurry, which has a sufficiently low density of coarse particles such that a semiconductor wafer can be polished with the CMP slurry without causing deep scratches, from a waste liquid of the used CMP slurry is disclosed. In this example, a removal step of removing the coarse particles in the CMP slurry having been used for polishing so as to reduce the number of coarse particles in the waste liquid, and a concentrating step of applying a centrifugal force to the waste liquid after the removal step to concentrate the waste liquid so as to obtain a CMP slurry raw material are performed. Thus, the method of manufacturing a CMP slurry raw material, in which the CMP slurry raw material is reproduced from the recycled waste fluid of the used CMP slurry, is disclosed (for example, Japanese Unexamined Patent Publication 2002-170793).

As another example of recycling a used slurry, a technology aiming to ultimately utilize a recycled polishing slurry without any problems is disclosed (for example, Japanese Unexamined Patent Publication 2004-75859) as the used slurry such as a CMP (chemical mechanical polishing) slurry is purified by removing metal ions therefrom such that metal contamination of semiconductor wafer and the like is prevented as much as possible. In this technology, a method of purifying the slurry is provided as chelate-forming fibers, in which a functional group having a metal-chelate-forming ability is introduced into a fiber molecule, can efficiently capture and remove metal ions of iron, aluminum, copper, nickel, zinc, chromium, molybdenum, tungsten, etc. existing in the polishing slurry.

Furthermore, a technology aiming to remove aggregated abrasive grains, cutting debris, and other unwanted matter without using a filter in recycling a used slurry is disclosed (for example, Japanese Unexamined Patent Publication 2004-63858). In this technology, the used slurry discharged from a CMP apparatus or other polishing apparatuses is subject to a concentration adjusting process, a particle diameter adjusting process, and a pH adjusting process. Here, the particle diameter adjusting process is characterized in that the processing is performed by a particle diameter adjustment process unit comprising an aggregated abrasive grain pulverization process unit that performs pulverization by an ultrasonic wave irradiation process or the like; a temperature separation process unit for separating aggregated abrasive grains from normal abrasive grains by the control so as to keep the slurry in a non-uniform temperature; and an aggregated abrasive grain discharging process unit for discharging the aggregated abrasive grains and the like having been separated.

Also, a technology aiming to provide a recovery apparatus of a polishing material for recovering and recycling particles of the polishing material efficiently from a waste fluid containing the polishing material discharged from CMP processing adopted in a semiconductor manufacturing plant or the like is disclosed (for example, Japanese Unexamined Patent Publication 2002-331456). Here, as the recovery apparatus of the polishing material which is recovered from the waste fluid of the CMP processing with a silica-based slurry, an apparatus comprising a membrane separation unit into which the waste fluid is introduced, a cleaning unit for cleaning the concentrated fluid obtained by the membrane separation unit, and an adjusting unit for adjusting the pH of the concentrated fluid having been cleaned is disclosed.

Resource saving and cost reduction may be achieved in the above-described slurry recycling methods and the like. However, the polishing characteristics of such recycled slurry do not excel those of an unused slurry, and the recycled slurry can be evaluated as a substitute for the unused slurry. Therefore, it is not necessarily possible to manufacture a slurry having better polishing characteristics with such methods.

Meanwhile, a technology aiming to provide an aqueous dispersion for chemical mechanical polishing capable of sufficiently flattening a surface having been polished and having high storage stability is disclosed (for example, Japanese Unexamined Patent Publication 2004-266155), in which the aqueous dispersion for chemical mechanical polishing is prepared by mixing an aqueous dispersion (I) that is obtained by blending at least a water-soluble quaternary ammonium salt, an inorganic acid salt, and an aqueous medium; and an aqueous dispersion (II) that is obtained by blending at least a water-soluble polymer, a basic organic compound excluding a water-soluble quaternary ammonium salt, and an aqueous medium, and further combining abrasive grains with at least one of the aqueous dispersions (I) and (II). In this chemical mechanical polishing method, surface defects such as dishing, erosion, and scratch in the processing of flattening the surface having been polished can be suppressed, and polishing removal selectivity between polysilicon and silicon oxide and polishing removal selectivity between polysilicon and nitrides are evaluated high. It is also disclosed that the aqueous dispersion for chemical mechanical polishing has high stability in a concentrated state and exhibits excellent polishing characteristics when diluted with water.

SUMMARY OF THE INVENTION

However, the slurry that includes such aqueous dispersion for chemical mechanical polishing is prepared in advance before processing of polishing such that the actual processing of polishing is conducted under predetermined external conditions. Also, it is generally considered that the polishing conditions become milder and more favorable for finish polishing when the slurry is diluted with water because the density of particles of the polishing material is lowered, although such a macroscopic perspective may not necessarily be applicable with some types of slurry in actuality.

In the abovementioned processing of polishing under the predetermined external conditions, it is assumed that a member to be polished (for example, a semiconductor wafer) is polished under substantially the same polishing conditions from the start to the end of the processing, but in reality the shape and properties of the surface of the member being polished change with the progress of the processing of polishing such that the polishing is not necessarily performed under the same conditions even if the external conditions are the same. On the other hand, it has been found that more favorable characteristics could be obtained in polishing the member by proactively changing the polishing conditions.

For example, it has also been found that it could be difficult to obtain better polishing conditions for finishing once colloidal silica aggregates, even though the slurry containing the colloidal silica is diluted to lower the macroscopic density of particles of the polishing material so as to make the polishing conditions milder to achieve a finer surface finishing state. It has also been found that it is difficult for largely aggregated colloidal silica to reach the surface being polished.

In one embodiment of the present invention, a polishing method for finishing a semiconductor wafer with a slurry containing colloidal silica and water-soluble polymer is provided. The polishing method comprises the steps of: diluting the slurry at a predetermined proportion with a diluent; and supplying the diluted slurry. Here, the diluent contains an aggregation preventing agent and has a colloidal density lower than that of the slurry. And the diluted slurry may have a pH value of at least 9. The predetermined proportion is changed in response to a surface condition of the semiconductor wafer.

In another embodiment of the present invention, a diluted slurry supplying apparatus utilized in a polishing apparatus for finishing a semiconductor wafer with a slurry containing colloidal silica and water-soluble polymer is provided. The diluted slurry supplying apparatus comprises a slurry supplier capable of supplying the slurry containing the colloidal silica and the water-soluble polymer; a diluent supplier capable of supplying a diluent containing an aggregation preventing agent to dilute the slurry; a mixer capable of receiving the slurry and the diluent having been supplied from the slurry supplier and the diluent supplier, respectively, the mixer forming a diluted slurry with a pH value of at least 9; and an ultrasonic vibrator capable of applying an ultrasonic vibration to the diluted slurry staying in the mixer or being fed out from the mixer. Here, the diluent supplying apparatus can change a dilution proportion of the diluted slurry.

Further features of the present invention, its nature, and various advantages will be more apparent from the accompanying drawings and the following description of the preferred embodiment.

DETAILED DESCRIPTION OF PREFERRED EMBODIMENT

Now, embodiments of the present invention are described below with reference to the attached drawings and the following description is provided for describing the embodiments of the present invention and the present invention is not limited to the embodiments. The same or related symbols refer to the same or the same type of elements and redundant description may be omitted.

Figure 1:
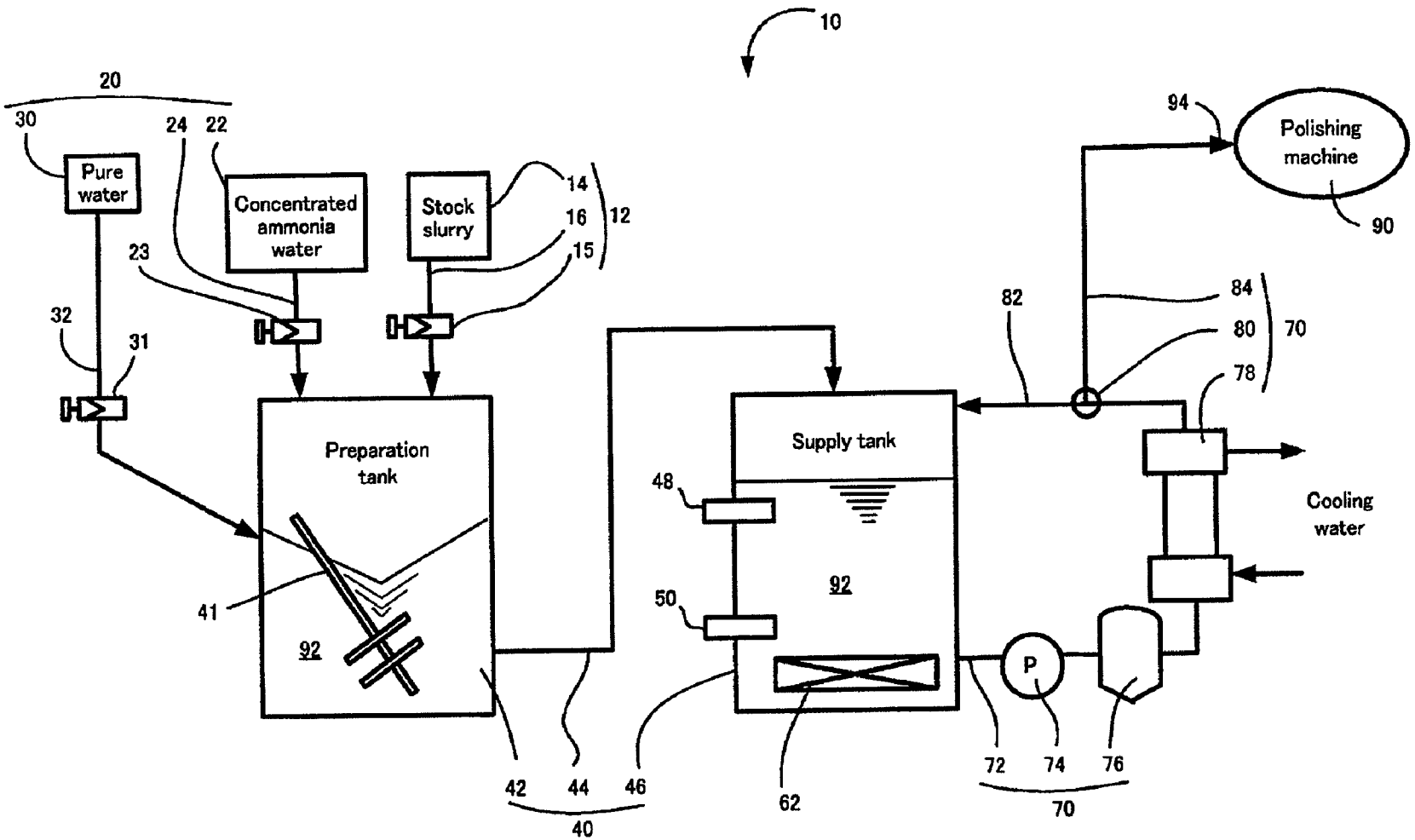
FIG. 1 is a schematic diagram showing a slurry supplying apparatus according to an embodiment of the present invention.

FIG. 1 is a schematic diagram showing a slurry supplying apparatus according to an embodiment of the present invention. The slurry supplying apparatus 10 is an apparatus that supplies a diluted slurry for finish polishing to a polishing machine 90 in a polishing step in which a semiconductor wafer is polished with the diluted colloidal silica slurry. The slurry supplying apparatus 10 includes a slurry supplying unit 12 (corresponding to slurry supplying means) capable of supplying a stock colloidal silica slurry (i.e., undiluted slurry containing colloidal silica), a diluent supplying unit 20 (corresponding to diluent supplying means) capable of supplying diluents (concentrated ammonia water and pure water) for diluting the stock colloidal silica slurry, a receiving unit 40 (corresponding to receiving means) capable of receiving and mixing the stock colloidal silica slurry and the diluents that are supplied, an ultrasonic wave generating device 62 (corresponding to ultrasonic wave generating means) capable of applying an ultrasonic processing to the mixed fluid inside the receiving unit 40, and a supplying unit 70 (corresponding to supplying means) capable of supplying the diluted colloidal silica slurry retained in the receiving unit 40 to the polishing machine 90.

The slurry supplying unit 12 mainly comprises a stock slurry supplying unit 14, a flow control valve 15 capable of varying a flow rate, and a stock slurry supply pipe 16, and is connected to a preparation tank 42 via the flow control valve 15 capable of varying the flow rate of the stock slurry. The stock slurry supplying unit 14 may, for example, be a storage tank with a cylindrical shape that stores the stock colloidal silica slurry therein.

The diluent supplying unit 20 includes an ammonia water supplying part, which mainly comprises an ammonia water supplying unit 22 that is arranged in parallel to the slurry supplying unit 12; a flow control valve 23 capable of varying the flow rate; and an ammonia water supply pipe 24, and a pure water supplying part, which mainly comprises a pure water supplying unit 30; a flow control valve 31 capable of varying the flow rate; and a pure water supply pipe 32. The ammonia water supplying unit 22 is connected via the ammonia water supply pipe 24 having the flow control valve 23 to the preparation tank 42 and has, for example, a storage tank having a cylindrical shape that stores the concentrated ammonia water therein.

The pure water supplying unit 30 supplies the pure water, which is capable of diluting the stock slurry along with the concentrated ammonia water. The pure water supplying unit 30 is connected via the pure water supply pipe 32 having the flow control valve 31 to the preparation tank 42 and supplies the preparation tank 42 with the pure water, which has been fed with a predetermined water pressure out of the system, but a storage tank may be installed for storing the pure water in the same manner.

The receiving unit 40 mainly comprises the preparation tank 42, a supply tank 46, and a connecting pipe 44 that connects these components. The preparation tank 42 is a tank with a capacity that is suitably selected according to a supply amount of the diluted slurry and has the stock slurry supply pipe 16, the ammonia water supply pipe 24, and the pure water supply pipe 32 connected to an upper portion as described above. A conventional stirrer 41 for stirring and mixing the injected fluids is disposed in the preparation tank 42. However, the stirrer does not have to be provided. The connecting pipe 44 provided with a sluice valve (not shown) is connected to a lower portion of the preparation tank 42 to enable a mixed fluid 92 to flow out.

The supply tank 46 is a tank with substantially the same capacity as the preparation tank 42 and is disposed at a lower position to enable the mixed fluid to be led into the supply tank 46 by the gravity. Alternatively, a pump may be interposed to pressure feed the mixed fluid. A thermometer 48 for temperature measurement of the mixed fluid 92, a pH meter 50 for pH value measurement, and the ultrasonic wave generating device 62 for applying the ultrasonic processing to the mixed fluid 92 are disposed in the supply tank 46. A delivery pipe 72 is connected to a lower portion of the supply tank 46 and the diluted slurry that has been subject to the ultrasonic processing is delivered therefrom.

A known device may be used as the ultrasonic wave generating device 62, which includes a vibrator disposed inside the supply tank 46 or made in contact with an exterior thereof, and an oscillator (not shown) that is disposed outside of the supply tank 46 and makes the vibrator vibrate.

The supplying unit 70 mainly comprises delivery pipes 72, 84, installed from the supply tank 46 to the polishing machine 90, a pump 74 capable of applying a pressuring force to the diluted slurry 94 for finish polishing, a filter 76 capable of filtering out foreign matter, a heat exchanger 78 capable of controlling the temperature of the diluted slurry 94 for finish polishing, and a switching valve 80 capable of switching flow paths. The delivery pipe 72 is connected from a lower portion of the supply tank 46 to the switching valve 80 via the pump 74, the filter 76, and the heat exchanger 78 interposed in the middle in this order. The delivery pipe 72 is made to communicate with the delivery pipe 84 via the switching valve 80, the delivery pipe 84 is installed to the polishing machine 90, and the diluted slurry 94 for finish polishing stored in the supply tank 46 can thus flow from the delivery pipe 72, and be supplied to the polishing machine 90 through the switching valve 80 and the delivery pipe 84. The delivery pipe 72 is also branched at the switching valve 80 and connected with a branch pipe 82 as the branch pipe 82 is connected to an upper part of the supply tank 46 so that the diluted slurry 94 for finish polishing, which has flowed through the delivery pipe 72, can be returned to the supply tank 46. The pump 74 is a general-purpose liquid delivery pump.

The filter 76 is a foreign matter filtration filter, which removes foreign matter equal to or greater than a predetermined size that is contained in the diluted slurry 94 for finish polishing that is pressurized by the pump 74. A depth filter, a membrane filter, or another filter through which the fluid can be filtered, can be applied as the filter 76.

The heat exchanger 78 is a general heat exchanger and adjusts the temperature of the diluted slurry 94 for finish polishing by using cooling water to cool the diluted slurry 94 for finish polishing that has been filtered through the filter 76. These parts are controllable by a controller (not shown).

Figure 2:
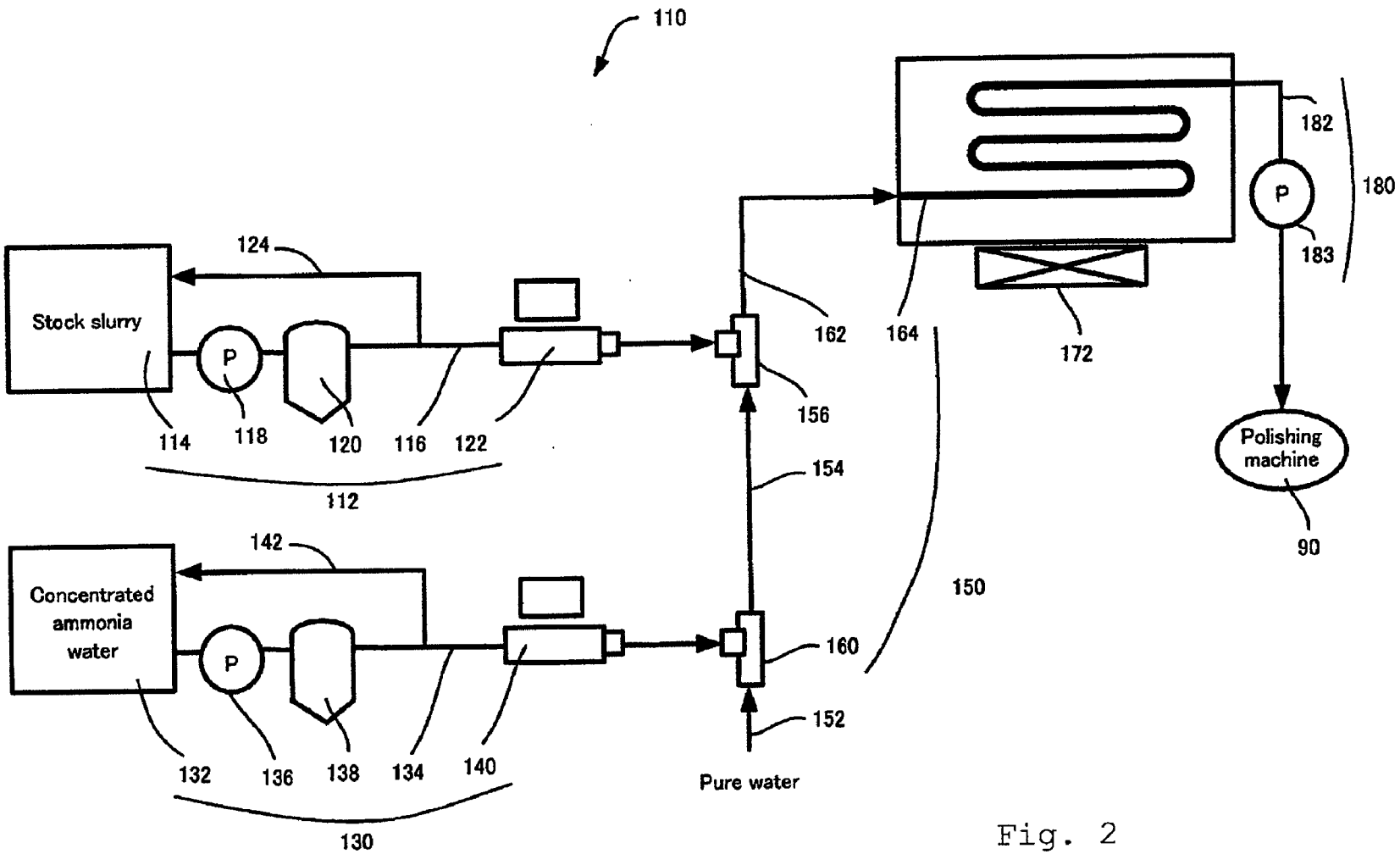
FIG. 2 is a schematic diagram showing another type of slurry supplying apparatus.

FIG. 2 is a schematic view of another type of slurry supplying apparatus. The slurry supplying apparatus 110 includes a slurry supplying unit 112 (corresponding to the slurry supplying means) capable of supplying the stock colloidal silica slurry, a diluent supplying unit 130 (corresponding to the diluent supplying means) capable of supplying the diluents for diluting the stock colloidal silica slurry, a receiving unit 150 (corresponding to the receiving means) capable of receiving and mixing the stock colloidal silica slurry and the diluents that are supplied, an ultrasonic wave generating device 172 (corresponding to the ultrasonic wave generating means) capable of applying the ultrasonic processing to the mixed fluid (corresponding to the diluted slurry) fed out from the receiving unit 150, and a supplying unit 180 (corresponding to the supplying means) capable of supplying the diluted colloidal silica slurry in the receiving unit 150 to the polishing machine 90, and the slurry supplying apparatus 110 is in a type of apparatus characterized in that the receiving unit 150 includes neither the preparation tank 42 nor the supply tank 46 which is shown in FIG. 1.

The slurry supplying unit 112 mainly comprises a slurry supplying part 114 that stores and supplies the stock colloidal silica slurry, a slurry supply pipe 116, a pump 118, a filter 120, and a mass flow controller (MFC) 122. The slurry supplying part 114 is connected by the slurry supply pipe 116 to a first aspirator 156 to be described below via a sluice valve (not shown) capable of opening and closing a flow path, the pump 118, the filter 120, and the mass flow controller 122, in this order. The slurry supplying part 114 is, for example, a storage tank with a cylindrical shape that stores the stock colloidal silica slurry therein. The pump 118 is a general-purpose liquid delivery pump. The filter 120 is a foreign matter filtration filter, which removes foreign matter equal to or greater than a predetermined size contained in the stock slurry that is pressurized by the pump 118. A depth filter, a membrane filter, or another filter through which the fluid can be filtered can be applied as the filter 120. The mass flow controller 122 is a general flow controller that includes a flow meter and a servomotor and adjusts the flow rate of the stock slurry that flows into the first aspirator 156. The slurry supply tube 116 branches in two between the filter 120 and the mass flow controller 122, and the stock colloidal silica slurry that has overflowed is returned to the slurry supplying unit 114 by a branch pipe 124. The liquid delivery pressure to the mass flow controller 122 is thereby adjusted and the pump 118 can be put into a constant operation.

The diluent supplying unit 130 mainly comprises an ammonia water supplying unit 132, an ammonia water supply pipe 134, a pump 136, a filter 138, and a mass flow controller (MFC) 140. The ammonia water supplying unit 132 is connected by the ammonia water supply pipe 134 to a second aspirator 156 to be described below via a sluice valve (not shown), the pump 136, the filter 138, and the mass flow controller 140, in this order. The ammonia water supplying unit 132 is, for example, a storage tank with a cylindrical shape that stores the concentrated ammonia water therein. The pump 136 is a general liquid delivery pump of the same type as the pump 118. The filter 138 is a foreign matter filtration filter of the same type as the filter 120 and removes foreign matter equal to or greater than a predetermined size contained in the concentrated ammonia water that is pressurized by the pump 136. The mass flow controller 140 is a general flow controller of the same type as the mass flow controller 122 and adjusts the flow rate of the concentrated ammonia water that flows into the second aspirator 160. The ammonia water supply tube 134 branches in two between the filter 138 and the mass flow controller 140, and the ammonia water having overflowed is returned to the ammonia water supplying unit 132 by a branch pipe 142. The liquid delivery pressure to the mass flow controller 140 is thereby adjusted and the pump 136 can be put into a constant operation.

The receiving unit 150 is for receiving and mixing the stock colloidal silica slurry and the diluent having been diluted with pure water which are supplied and mainly comprises the first aspirator 156, a connecting pipe 154, the second aspirator 160, a connecting pipe 162, and an ultrasonic processing pipe 164 to which the ultrasonic processing is applied. The second aspirator 160 has its upstream side connected to the ammonia water supply pipe 134 of the diluent supplying means and a pure water supply pipe 152 for dilution of the concentrated ammonia water, and has its downstream side connected to the upstream side of the first aspirator 156 via the connecting pipe 154. The first aspirator 156 has its upstream side connected to the connecting pipe 154 as well as to the slurry supply pipe 116 of the slurry supplying unit 112 and has its downstream side connected to the ultrasonic process pipe 164 via the connecting pipe 162.

The second aspirator 160 is enabled to perform delivery at a flow rate of approximately 2 liters/min by the pure water of approximately 0.2 MPa that is supplied from the pure water supply pipe 152. The concentrated ammonia water having been supplied from the mass flow controller 140 is aspirated under reduced pressure by the second aspirator 160, passes through the ammonia water supply pipe 134, the second aspirator 160, and the connecting pipe 154 on the downstream side while the concentrated ammonia water is mixed and diluted with the supplied pure water. The diluted ammonia water is depressurized as it passes through the first aspirator 156 such that the stock slurry supplied from the mass flow controller 122 is aspirated and mixed with the diluted ammonia water to be diluted, and then the diluted slurry is provided to be fed out to the connecting pipe 162 installed on the downstream side at a flow rate of approximately 2 liters/min.

The ultrasonic processing pipe 164 is a pipe having been elongated in a zig-zag manner (as the pipe extends to reciprocate several times between two imaginary parallel lines separated with a prescribed distance) along the flow path and is constituted of a PVDF (polyvinylidene fluoride) pipe to which the ultrasonic processing is applicable. The ultrasonic processing pipe 164 has its upstream side connected to the connecting pipe 162 and has its downstream side connected to a delivery pipe 182. The ultrasonic processing pipe 164 is not limited to a round or square cross-sectional pipe, but may be the pipe made of PVDF (polyvinylidene fluoride) having a hollow part along the path line in any cross-sectional shape, in which the diluted slurry for finish polishing flows.

The ultrasonic wave generating device 172 is provided to apply the ultrasonic processing to the mixed fluid to prepare the diluted slurry for finish polishing. The ultrasonic wave generating device 172 is a conventional device and includes a vibrator provided near the ultrasonic processing pipe 164 and an oscillator (not shown) making the vibrator vibrate.

The supplying unit 180 includes the delivery pipe 182 that supplies the diluted slurry for finish polishing to the polishing machine 90 and also includes a pump 183 as an optional unit. The delivery pipe 182 has its upstream end connected to the ultrasonic processing pipe 164 and its downstream end connected to the polishing machine 90. Since the temperature of the diluted slurry may be increased readily by the ultrasonic processing, a heat exchanger (not shown) may be interposed in the delivery pipe 182 to adjust the temperature of the diluted slurry supplied to the polishing machine. These parts are connected to and made controllable by a controller (not shown).

A method for manufacturing the diluted slurry 94 for finish polishing with the slurry supplying apparatus 10 shall now be described in reference to FIG. 1. First, the stock slurry fluid, containing approximately 3 weight % of colloidal silica and having approximately 3 weight % of a water-soluble polymer added, is injected from the stock slurry supplying unit 12 into the preparation tank 42. The stock slurry fluid contains a minute amount of ammonia water.

Such slurry is commercially available in general, for example, GLANZOX™ made by Fujimi Incorporated, slurries for silicon wafer made by Nitta Haas Inc. (e.g., the Napopure series and the NALCO™ series), and so on. As an example of the colloidal silica, Snowtex made by Nissan Chemical Industries Ltd. can be referred to. The water-soluble polymer agent may contain at least one of cellulose, ethylene glycol, and the like.

Here, in general, cellulose and derivatives thereof such as methylcellulose, methylhydroxyethylcellulose, methylhydroxypropylcellulose, hydroxyethylcellulose, hydroxypropylcellulose, carboxymethylcellulose, carboxyethylcellulose, and carboxymethylhydroxyethylcellulose, etc.; polysaccharide and derivatives thereof such as chitosan, etc.; and water-soluble polymers such as polyethylene glycol, polyethyleneimine, polyvinylpyrrolidone, polyvinyl alcohol, polyacrylic acid and salts thereof, polyacrylamide, polyethylene oxide, etc. can be referred to as examples of the water-soluble polymer agent, and among these, the cellulose and derivatives thereof; and polyacrylic acid and salts thereof are preferable, and hydroxyethylcellulose and carboxymethylcellulose are more preferable. Each of these water-soluble polymers may be used solitarily or two or more types may be used upon mixing. A blending amount of the water-soluble polymer with respect to a total amount of each of a component blending type of water-based dispersion and a two-liquid mixing type of water-based dispersion may be 0.005 to 5 mass %, more preferably 0.005 to 3 mass %, yet more preferably 0.008 to 2 mass %, and especially preferably 0.01 to 1 mass %. An effect of reducing dishing and erosion may become insufficient and surface defects may increase in some cases where the blending amount of the water-soluble polymer is less than 0.005 mass %. The blending amount of 5 mass % may be sufficient.

A predetermined amount of the concentrated ammonia water from the ammonia water supplying unit 22 and a predetermined amount of pure water from the pure water supply pipe 32 are injected into the preparation tank 42. Preparation is then performed by stirring by the stirrer 41 so that the pH value of the mixed fluid with the injected stock slurry becomes 9 to 10.5. The slurry stock is thereby diluted by several times to several ten times to form the diluted slurry. Also, natural mixing by inflow of the respective fluid from the respective supply pipes 14, 24, 32 may be performed without using the stirrer 41.

The mixed fluid 92 that has been mixed sufficiently inside the preparation tank 42 is fed from the connecting pipe 44 into the supply tank 46. Here, the pH meter 50 is used to adjust the pH value of the mixed fluid 92 that has been fed into the supply tank 46 to be within a range of approximately 9 to 11, preferably approximately 9.5 to 10.5, and more preferably approximately 10.2 to 10.3. If the pH value has a higher alkalinity than the predetermined range, suitable amounts of the concentrated ammonia water and pure water, such that the pH value falls within the predetermined range, are injected into the preparation tank 42 from the ammonia water supplying unit 22 and the pure water supply pipe 32 to prepare a suitably diluted ammonia water. The diluted ammonia water is injected into the supply tank 46 to adjust the pH value of the mixed fluid 92 into the predetermined range. On the other hand, if the pH value of the mixed fluid 92 is lower than the predetermined range and close to the neutral, a suitable amount of the stock slurry is injected into the preparation tank 42 from the stock slurry supplying unit 14 such that a pH value may be in a predetermined range, and then this stock slurry fluid is added to the mixed fluid 92 inside the supply tank 46 to adjust the pH value of the mixed fluid 92 within the predetermined range.

The ultrasonic wave generating device (not shown) is started to operate after detecting that the pH value of the mixed fluid 92 is within the predetermined range. The oscillator (not shown) of the ultrasonic wave generating device 172 is set such that a voltage of 100V and a power of 100 to 1200 W (for example, 320 W) is applied in order to make the vibrator vibrate at a frequency of 10 to 45 kHz (for example, 28 kHz) and the ultrasonic processing is applied to the diluted slurry for 5 minutes. Numerous cavitation bubbles are generated in the slurry by the ultrasonic irradiation, shock microwaves are generated when the cavitation bubbles burst, and it is considered that the gelled (aggregated) slurry in the mixed fluid 92 are pulverized to fine particles by the energy of the shock microwaves to produce a slurry having fine particles of small diameters. In this process, a portion of the applied ultrasonic energy is converted to heat energy and increases the overall temperature of the mixed fluid 92.

Here, it is detected by the thermometer 48 that the temperature of the mixed fluid 92 inside the supply tank 46 is within a predetermined range of approximately 20° C. to 40° C. In the case where the temperature is higher than the predetermined range, the switching valve 80 is so adjusted that a flow path is formed by the delivery pipe 72 and the branch pipe 82, a flow path is not formed by the delivery pipe 72 and the delivery pipe 84, and a closed flow path enabling circulation among the supply tank 46, the delivery pipe 72, and the branch pipe 82 is thus formed. Thereafter, the pump 74 is started to operate to carry the mixed fluid 92 in the supply tank 46 to the heat exchanger 78. After the mixed fluid 92 has been cooled by the heat exchanger 78, it is returned again to the supply tank 46 via the branch pipe 82. The mixed fluid 92 is circulated inside the closed flow path until the temperature of the mixed fluid 92 decreases to be within the predetermined range.

When the temperature falls within the predetermined range, the mixed fluid 92 inside the supply tank 46 can be used as the diluted slurry 94 for finish polishing. The switching valve 80 is so switched that the slurry does not flow into the branch pipe 82. In the case of performing the finish polishing, the switching valve 80 is so switched that the flow from the delivery pipe 72 to the delivery pipe 84 is enabled, and the pump 74 is started to operate to supply the mixed fluid 92 inside the supply tank 46 as the diluted slurry 94 for finish polishing to the polishing machine 90.

The diluted slurry 94 for finish polishing is a slurry that contains the water-soluble polymer and solvent to which a predetermined compound with a function of preventing condensation of the water-soluble polymer is added, and is supplied from the delivery pipe 84 to the polishing machine 90 to be used for finish polishing of the semiconductor wafer.

Now, a method of manufacturing the diluted slurry 94 for finish polishing by the slurry supplying apparatus 10 shall now be described in reference to FIG. 2. First, the pump 118 is started to operate to make a predetermined amount of the stock slurry fluid (containing colloidal silica) having approximately 3 weight % of the water-soluble polymer added thereto flow from the stock slurry supplying part 114 into the slurry supply pipe 116. The water-soluble polymer agent contains at least one of cellulose, ethylene glycol, and the like.

The sluice valve (not shown) is opened to make the pure water flow from the pure water supply pipe 152 to the second aspirator 160 and then to the first aspirator 156. The concentrated ammonia water and the stock slurry are thereby aspirated by the second and the first aspirators and mixed and diluted with the pure water. That is, as the pure water flows through the second aspirator 160, the connecting pipe 154, the first aspirator 156, and the connecting pipe 162, the concentrated ammonia water becomes the diluted ammonia water and the stock slurry becomes the diluted slurry. The ultrasonic processing is applied to the diluted slurry at the ultrasonic processing pipe 164 to enable the aggregated colloidal silica to be disintegrated. The diluted slurry that contains the colloidal silica that has been made fine is thus supplied from the delivery pipe 182 to the polishing machine.

The semiconductor wafer polishing method is largely divided into primary polishing and secondary polishing (finish polishing), and the finish polishing is divided further into pre-stage polishing and final polishing. The primary polishing is a step of polishing the semiconductor wafer roughly and is aimed at polishing and flattening waviness and surface unevenness of the semiconductor wafer. The polishing slurry of comparatively large average particle size is thus used in the primary polishing, and it is preferable to use the colloidal silica slurry in which KOH is added as a pH adjuster in advance for adjustment of the particle size distribution and the water-soluble polymer is not added. The pre-stage polishing of the secondary polishing is aimed at removing defects and damage on the semiconductor wafer surface after the primary polishing to further flatten the surface roughness. Since the polishing slurry with particles of a finer average particle size than those used in the primary polishing is thus preferable in the secondary polishing, the ammonia water for dilution is further added and thereafter the ultrasonic wave is applied to the colloidal silica slurry containing the water-soluble polymer. Colloidal silica having an average particle size of 10 to 100 nm can be utilized in such polishing fluid.

The final polishing in the secondary polishing is applied for the purpose of further polishing the semiconductor wafer after the pre-stage polishing to a final quality and adding a polymer film as a protective film on the semiconductor wafer surface after the end of polishing. The polishing slurry used in the final polishing is thus required to have a function of adding the protective film and, for example, the colloidal silica slurry having the ammonia water as the solvent and having the water-soluble polymer added is used.

TABLE 1

| Characteristics | Ref: Water dilution | New fluid dispersion |
|---|---|---|
| Average particle diameter of slurry | 1250 nm | 59 nm |
| Specific gravity | 1.002 | 1.002 |
| Particle density in slurry | 465 pcs/cc | 163 pcs/cc |
| Slurry viscosity | 2.1 CP | 1.2 CP |
| Slurry zeta potential | 5.86 mV | 6.81 mV |
| Slurry pH | 9.86 | 10.28 |
| Polishing rate (Si) | 0.026 μm/min | 0.033 μm/min |
| Polishing rate ($SiO_2$) | 0.82 Å/min | 2.51 Å/min |
| Microroughness (TMS) | Rms = 1.09 nm | Rms = 1.01 nm |
| Wafer water retentiveness (Time) | 65 sec | 25 sec |
| Haze level (Haze) | 0.024 ppm | 0.036 ppm |

The characteristics of the diluted slurries for finish polishing diluted with water and with ammonia water are summarized in a comparison manner in Table 1, the diluted slurry with the ammonia water being subject to the ultrasonic processing. Both slurries are diluted by 20 times in the same manner. The characteristics of the slurry diluted just with the pure water as the diluent are shown in the left column, and the characteristics of the slurry diluted with the ammonia water having been diluted with the pure water and being furthermore subject to the ultrasonic processing are shown in the right column. It can be seen that the average particle diameter of the slurry was 59 nm such that the particles were hardly aggregated in the case of dilution with the ammonia water whereas the average particle diameter of the slurry was as large as 1250 nm in the case of dilution with water. The specific gravity was 1.002 in both cases, the numbers of particles in the slurries diluted with the water and with the ammonia water were 465 and 163 pcs/cc, respectively, and the slurry viscosities were 2.1 and 1.2 CP, respectively such that the former is about twice as large as the latter. It is considered that the contained water-soluble polymer was a major factor to have caused such differences that more particles of readily detectable size are generated in the case of dilution with the water so as to increase the viscosity probably because of mutual interaction among the water-soluble polymer. Meanwhile, in regard to zeta potential, which is used as an indicator of tendency of aggregation of colloids, a higher value is shown in the case of dilution with the ammonia water followed by the ultrasonic processing than that in the case of dilution with the water, and it is considered that a better-dispersed state could be maintained readily if the slurry is diluted with the ammonia water followed by the ultrasonic processing. The pH value was 10.28 in the case of the slurry diluted with the ammonia water followed by the ultrasonic process whereas the pH value was 9.86 so as to be more on the acidic side in the case of the slurry diluted with the water. It is considered that this is an effect of the ammonia water.

Polishing rates of the slurries on the basis of Si were 0.026 μm/min and 0.033 μm/min, respectively such that the polishing rate in the case of the slurry diluted with the ammonia water followed by the ultrasonic processing was higher than that in the case of the slurry diluted with the water. The polishing rates on the basis of $SiO_2$ were 0.82 Å/min and 2.51 Å/min, respectively such that the polishing rate in the case of the slurry diluted with the ammonia water followed by the ultrasonic processing was higher by approximately three times in comparison to that in the case of the slurry diluted with the water. Values of microroughness of the wafers having been polished with the diluted slurry for polishing having been diluted with the water and that with the diluted slurry for polishing having been diluted with the ammonia water followed by the ultrasonic processing were Rms=1.09 nm and Rms=1.01 nm, respectively, and hardly differed. Water retention of the wafer was 65 seconds in the case of the slurry diluted with the water and as opposed to 25 seconds, which is less than half, in the case of the slurry diluted with the ammonia water followed by the ultrasonic processing. The haze level was 0.024 ppm in the case of the slurry diluted with the water as opposed to 0.036 ppm, which indicates the poorer result, in the case of the slurry diluted with the water. In general, the haze level tends to degrade as the polishing rate is high.

Figure 3:
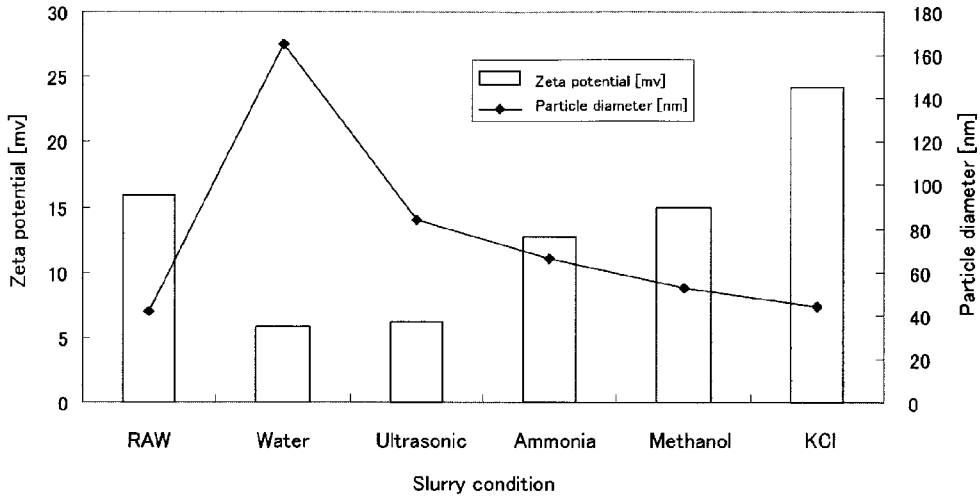
FIG. 3 shows a graph of zeta potentials and average particle diameters under various conditions of the commercially available slurry.

FIG. 3 is a graph of zeta potentials and average particle diameters under various conditions of the commercially available slurry as mentioned above. While the zeta potential was approximately 16 mV in the case of the commercially available slurry in a stock state (indicated by "RAW"), it decreased drastically to approximately 6 mV when the stock slurry was diluted with water (indicated by "Water") and it hardly increased even when the ultrasonic processing was applied (indicated by "Ultrasonic"). However, the zeta potential was approximately 13 mV and close to that of the stock slurry when the slurry was diluted with a diluent containing ammonia water (indicated by "Ammonia"). The slurry diluted with a diluent containing methanol exhibited an even higher value of approximately 15 mV (indicated by "Methanol"). Furthermore, the slurry diluted by a diluent containing KCl exhibited a value of approximately 24 mV that exceeds that of the stock slurry (indicated by "KCl"). From these results, it is considered that the KCl is the best and the methanol is the second best in terms of dispersion. Meanwhile, the average particle diameter was approximately 42 nm in the case of the stock slurry, approximately 165 nm in the case of the slurry diluted with the water, approximately 84 nm in the case of the slurry diluted with the water followed by the ultrasonic processing, approximately 66 nm in the case of the slurry diluted with the ammonia water, approximately 53 nm in the case of the slurry diluted with methanol, approximately 44 nm in the case of the slurry diluted with the KCl, and thus the particle size results match the zeta potential measurement results.

Figure 6:
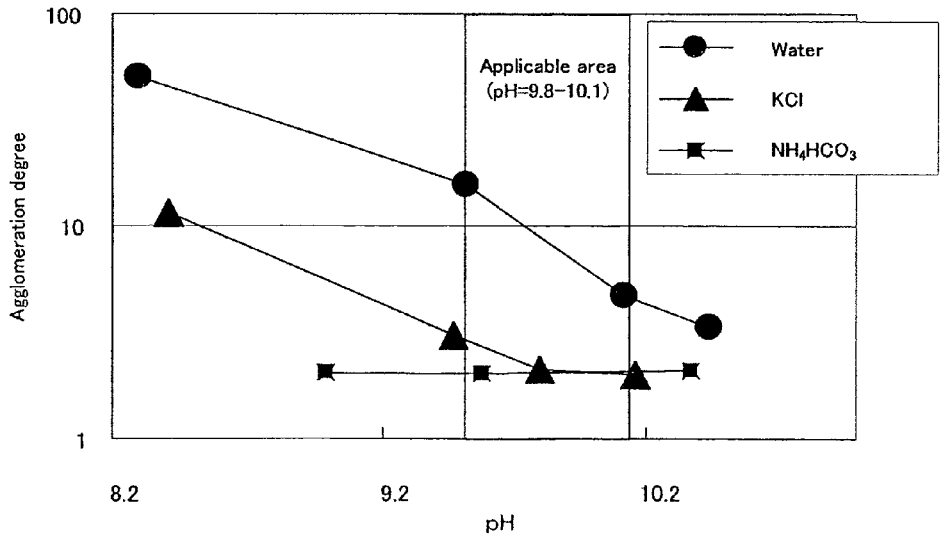
FIG. 6 shows a graph in which an aggregation degree of diluted slurries under various dilution conditions is plotted against a pH value.

Here, the dilution with the KCl was thus the most preferable for dispersion of the colloidal silica, particularly in the system containing the water-soluble polymer, and if a relationship between the pH value and the degree of aggregation is viewed in FIG. 6, the degrees of aggregation of the slurries diluted with the water and with the KCl are high when the pH value was less than 9. Meanwhile, no pH dependency from the degree of aggregation exhibits in FIG. 6 as the degree of aggregation was low and stable in the case of the slurry diluted with ammonia (actually, addition of ammonium bicarbonate). It can thus be understood that the slurry diluted with the ammonia was superior as the pH dependency was low since the variation of pH may occur by dilution of the stock slurry, consumption of the pH adjuster during the polishing process.

Figure 4:
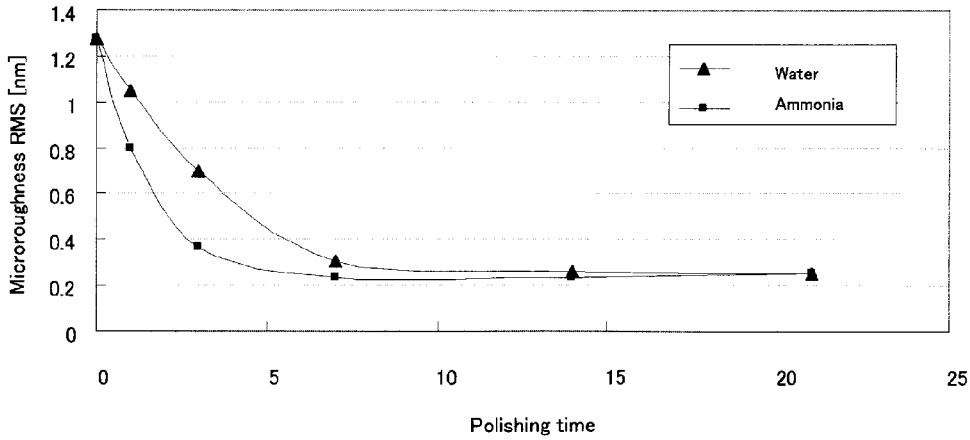
FIG. 4 shows a graph of a chronological change of microroughness in diluted slurries with water and with ammonia water.

In FIG. 4, the microroughness values of polished wafers are plotted against time (i.e., polishing time). Here, silicon wafers for secondary polishing (finish polishing) were prepared by performing the primary polishing (rough polishing) under the same conditions on a plurality of silicon wafers sliced from the same silicon ingot. Next, the finish polishing under the same external polishing conditions (for example, the same sliding speed, the same pressure, and the same polishing cloth) was then performed by the apparatus as shown in FIG. 1 while the commercially available slurry having the colloidal silica dispersed was supplied. The stock slurries were diluted with pure water and with water containing ammonia at the proportion having been determined in advance (25 parts of diluent with respect to 1 part of stock slurry) and then supplied by the slurry supplying apparatus 10 to the polishing machine 90. After performing polishing for a predetermined time (here, the maximum period of time is indicated by about 21 in an arbitrary unit), the semiconductor wafer (that is, the polished wafer) was taken out, and the surface roughness thereof was measured by an optical interference roughness meter made by Zygo Corp. The microroughness values versus the polishing time were plotted on the graph in the respective cases of the slurries diluted with the pure water and with the water containing ammonia. In a comparison of the case of the pure water and the case of the water containing ammonia, the microroughness values become nearly equal later in the polishing time although the microroughness values thereof differ greatly around 5 (polishing time) or shorter as clearly shown in FIG. 4. More specifically, it can be seen that the microroughness value decreased more slowly in the case of the slurry dilated with water than that in the case of the slurry diluted with the water containing ammonia probably because the colloidal silica particles were not supplied sufficiently to the polished surface due to aggregation of the colloidal silica particles. That is, it can be understood that the microroughness value in the case of the slurry diluted with the water decreased slower because of the lower polishing rate thereof in comparison to that in the case of the slurry diluted with the ammonia water followed by the ultrasonic processing.

Figure 5:
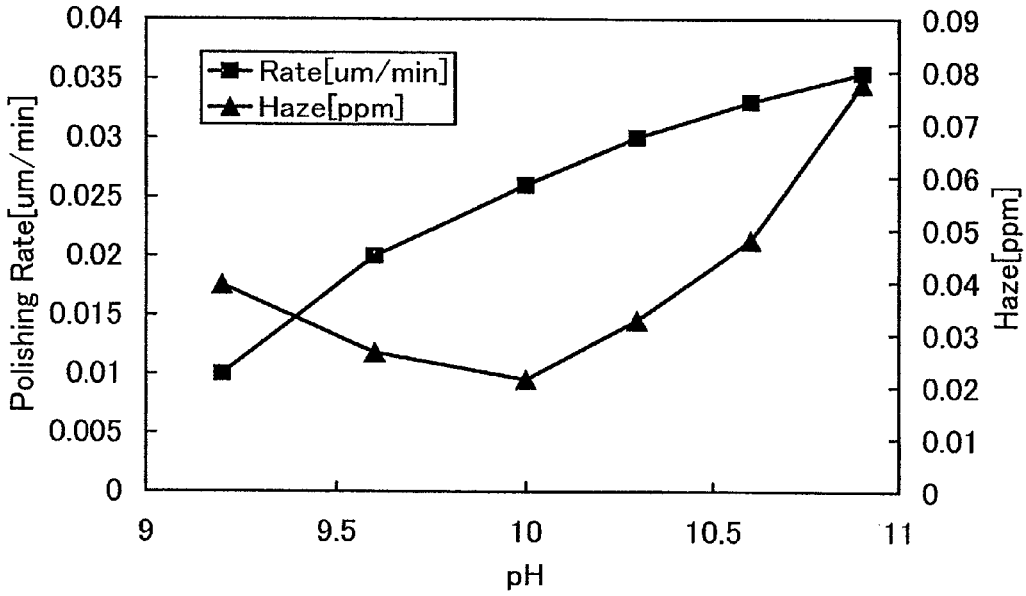
FIG. 5 shows a graph in which a polishing rate and a haze level of the slurry having diluted with ammonia water and processed by the ultrasonic vibration are plotted against a pH value.

FIG. 5 is a graph in which the polishing rate and the haze level were plotted against the pH value when the slurry diluted with the ammonia water followed by the ultrasonic processing were utilized in polishing the wafer. It can be understood from this graph that the polishing rate increased monotonously with an increase of the pH value whereas the haze level exhibited the minimum value at the pH value of approximately 10. Thus, if the polishing rate is more important, the higher pH value is more preferable, but it is considered the most preferable to use the diluted slurry in the pH value range of 9.5 to 10.5 after looking overall since the polishing rate and the haze level were in trade off relation.

Figure 7:
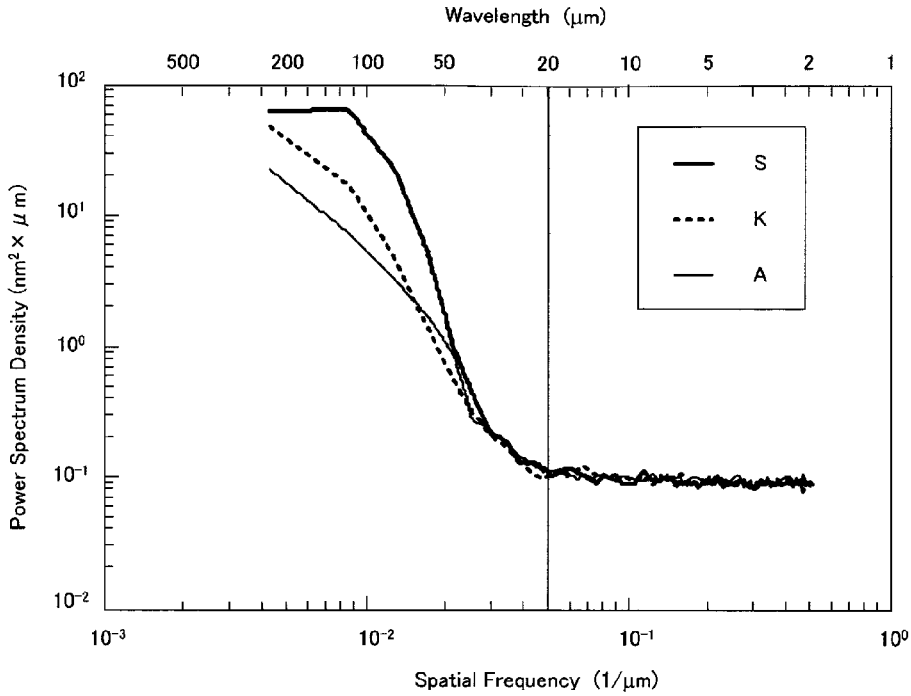
FIG. 7 shows a graph showing Fourier analysis results of the microroughness of silicon wafers having been subject to primary polishing using different slurries and then to secondary polishing under the same conditions using the same slurry diluted with ammonia water.

FIG. 7 is a graph of Fourier analysis results of the microroughness of silicon wafers that have been subject to primary polishing with different slurries and then to secondary polishing under the same conditions with the ammonia-water-diluted slurry (1 part of slurry diluted with 25 parts of the ammonia water diluent). The horizontal axis of FIG. 7 indicates the analysis frequency of the Fourier analysis and the vertical axis indicates the power spectrum density. Here, S indicates the results in the case of performing the primary polishing with a slurry in which approximately 4 weight % of colloidal silica particles having an average primary particle diameter of 40 nm were dispersed, K indicates the results in the case of performing the primary polishing using a slurry in which approximately 0.4 weight % of the colloidal silica particles having the average primary particle diameter of 40 nm were dispersed, and A indicates the results in the case of performing the primary polishing with a slurry in which approximately 4 weight % of colloidal silica particles having an average primary particle diameter of 10 nm were dispersed. As can be understood from this figure, each of the wafers exhibits substantially the same power spectrum density at an analysis frequency equal to or greater than approximately 0.022 (equal to or less than approximately 45 μm in terms of wavelength) and the power spectrum density of S is greatest at an analysis frequency equal to or less than approximately 0.02 (equal to or greater than approximately 50 μm in terms of wavelength). The power spectrum densities for K and A exhibit an increasing trend up to an analysis frequency of 0.004 (250 μm in terms of wavelength), and it can be understood that the power spectrum density of A becomes lowest when the analysis frequency is equal to or less than approximately 0.014 (equal to or greater than approximately 70 μm in terms of wavelength) but tends to become comparatively larger than the others near an analysis frequency of approximately 0.02 (approximately 50 μm in terms of wavelength). In particular, the power spectrum density at an analysis frequency equal to or greater than approximately 0.05 (equal to or less than approximately 20 μm in terms of wavelength) is closely related to the haze, and it can be understood that differences in the slurry used in the primary polishing have hardly any effect on the haze. On the other hand, it can be understood that the haze is hardly affected even when different slurries are used in the primary polishing as long as the secondary polishing is performed under the same conditions. It can thus be understood that the haze characteristic is not affected by a roughness of a comparatively long wavelength (such as waviness, etc.) and that in the case where the improvement of the haze characteristic is the ultimate objective, it suffices to optimize the conditions in the finish polishing even if the primary polishing conditions differ. Thus, for example, it is more preferable to use a slurry that is diluted with a diluent containing ammonia than to use a slurry diluted with pure water.

Polishing Mode

As described above, it was found that the polishing quality such as the polishing rate varies according to the characteristics (such as pH, type of diluent, etc.) of the polishing fluid having been supplied during polishing. It is well known that the polishing quality degrades unless a sufficient amount of polishing fluid is supplied. Hereafter, a polishing method is described in detail as the aforementioned characteristics are utilized, for example, the first half and the latter half of finish polishing are performed continuously in one-time polishing.

It can be understood that the polishing rate is important in an initial stage of polishing. Thus, it is preferable to dilute with water, more preferable to dilute with ammonia water, yet more preferable to dilute with methanol, and the most preferable to dilute with KCl if the polishing fluid characteristics that are effective in the polishing rate are utilized. Although the haze level is considered to degrade in this order, the choice of the slurries is not so important in the initial stage. In the slurry supplying apparatus as shown in FIG. 2, the slurry is diluted with ammonia water and the ultrasonic process is applied in the initial polishing. The ultrasonic processing is stopped at an intermediate stage, and polishing upon diluting the slurry with water can be continued in the final stage. Polishing can thereby be performed in a continuous manner from rough finishing to final finishing without changing polishing pads or else and the productivity can thus be improved significantly.

Figure 8:
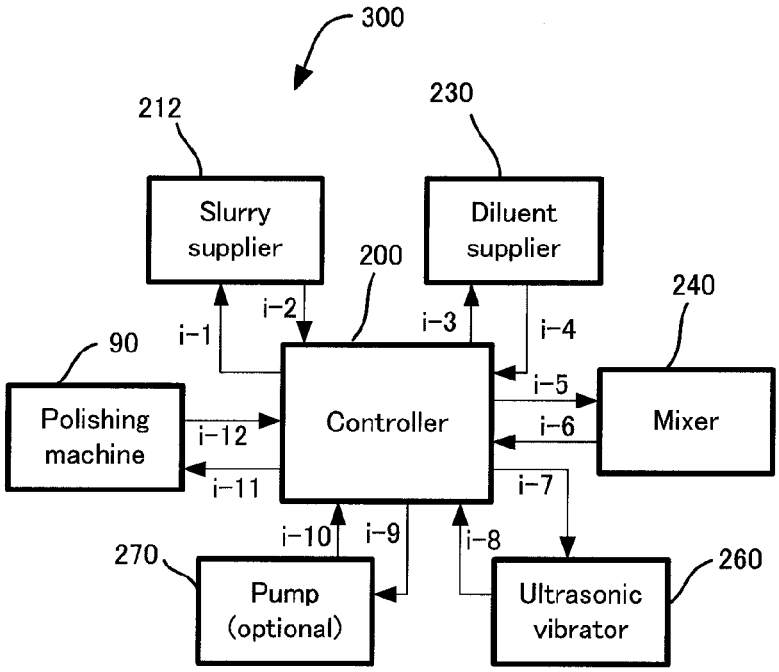
FIG. 8 is a block diagram showing a control system of a slurry supplying apparatus.

In the aforementioned embodiments, a system control may be performed utilizing a control system as shown in FIG. 8. The control system 300 of a slurry supplying apparatus, which may include the slurry supplying apparatuses 10 and 110, is shown in a block diagram. A controller 200 such as a computer, personal computer, micro computer, programmable computer and so on is connected to a slurry supplier 212 such as slurry supplying units 12 and 112, a diluent supplier 230 such as diluent supplying units 20 and 130, a mixer 240 such as receiving units 40 and 150, an ultrasonic vibrator 260 such as, an optional pump 270 such as supplying units 70 and 180, and a polishing machine 90 with communication lines which may be wired or wireless. The flow rates of stock slurry (raw slurry) and the diluent may be controlled by the controller 200 by signals i-1 and i-3, respectively, and actual flow rates thereof may be sent to the controller 200 from the slurry supplier 212 and the diluent supplier 230 through the line as signals i-2 and i-4, respectively. The mixing in the mixer 240 is controlled and monitored in accordance with signals i-5 and i-6, respectively, sent and received by the controller 200. The ultrasonic vibrator is also controlled and monitored in accordance with signals i-7 and i-8, respectively, sent and received by the controller 200. Then, in case the pump 270 to supply the diluted slurry is employed, the pump 270 may also controlled and monitored in accordance with signals i-9 and i-10, respectively, sent and received by the controller 200. The supply amount of the diluted slurry may be sent to the polishing machine by the signal i-11 transmitted from the controller 200 and the polishing machine 90 may provide a signal i-12 to start or stop supplying the diluted slurry to the controller 200. Thus, an optimum polishing operation may be performed as mentioned above.

In the present embodiment, the fluid may include liquid, slurry, diluent, water, and so on. And the slurry supplier may include a slurry supplying apparatus, a slurry supplying device, a slurry supplying unit, and slurry supplying means. The diluent supplier may also include a diluent supplying apparatus, a diluent supplying device, a diluent supplying unit, and diluent supplying means. The mixer may include a mixing device, a mixing unit, mixing means, a receiving device, a receiving unit, receiving means, and so on. The ultrasonic vibrator may include an ultrasonic vibrating device, an ultrasonic vibrating unit, ultrasonic vibrating means, an oscillator, and so on. These terms may be used interexchangeably throughout the specification.

In addition to the aforementioned embodiments, the following may be included in the present invention.

In the embodiments of the present invention, a method for controlling aggregation of colloidal silica having been dispersed in a slurry is provided when the slurry is diluted. According to one embodiment of the present invention, a method of controlling the polishing characteristics of the diluted slurry to be obtained by controlling the aggregation of the colloidal silica during dilution is provided. It has been found that polishing conditions that are more favorable for finish polishing of a member to be polished can be obtained in a substantially continuous manner along with the progress of polishing by varying the overall polishing characteristics by the control of the polishing characteristics of the diluted slurry even though the external conditions for polishing remain the same; or by varying the overall polishing characteristics by the variable control of the polishing characteristics of the diluted slurry according to the external conditions, and a polishing method capable of accommodating predetermined polishing conditions, material of the member being polished, and so on to obtain a favorable finishing state of the member having been polished.

A semiconductor wafer polishing method for finishing a semiconductor wafer by rubbing is provided as a slurry containing colloidal silica and water-soluble polymer is supplied. The method comprises: a diluting step of diluting an original slurry at a predetermined proportion with a diluent; and a step of supplying a diluted slurry obtained in the diluting step. Here, the diluent contains an aggregation preventing agent and has a colloidal density lower than that of the slurry. The diluted slurry has a pH value that is equal to or greater than 9. The predetermined proportion of dilution may be changed during the diluting step.

Here, the diluting step may be performed before the supplying step of supplying the diluted slurry. The diluting step may include a step for mixing or contacting the original slurry with a diluent that does not contain the colloidal silica or a diluting slurry (corresponding to the diluent herein) that has a colloidal density lower than that of the original slurry and a preparing step thereof. The predetermined proportion may mean a mixing ratio of the original slurry and the diluent, which can be determined in advance to obtain favorable polishing conditions and expressed by the volume (or the weight). To vary (or change) the predetermined proportion may be that the predetermined proportion is varied (or changed) as time passes while the polishing of the semiconductor wafer is being conducted (including "along with the progress of polishing" and "in the middle of one or more polishing steps"). Specifically, a gradual increase or decrease of the mixing ratio of the original slurry and the diluent during the step of polishing the semiconductor wafer may be included. Also, the increase and decrease may be repeated. The diluted slurry is made by dilution at the predetermined proportion at the time and the dilution may be performed in parallel to the step of polishing the semiconductor wafer. Thus, a time lag from the diluting step to the supplying step of actually supplying the thus-diluted slurry may be allowed to exist, and the predetermined proportion of dilution (corresponding to the proportion of the diluent when the proportion of the slurry is set to 1) of the diluted slurry can vary in the middle of one or more polishing steps in which the diluted slurry of the variable proportion is actually supplied. For example, when this time lag is long, the diluent may actually be mixed before the start of the polishing step of polishing the semiconductor wafer. The time lag is preferably short since feedback control tends to be difficult when it is long. Also the diluted slurry having been supplied may be held (or retained) in the middle of a supply path such that waste of thus-held slurry tends to occur such that it is preferable to contrive the path to minimize the amount of the held diluted slurry.

In general, the predetermined proportion of dilution, a degree of application of the ultrasonic processing, and so on may be varied in accordance with a monitored polishing rate or a magnitude or frequency of vibration caused by the monitored polishing in the processing of polishing the semiconductor wafer, which may be classified largely into a so-called rough polishing and a finish polishing that is further classified into a start polishing and a final polishing in a mid-size manner, in order to obtain favorable polishing conditions. Such monitoring may be performed automatically or performed manually by a worker. For example, the proportion of dilution may be increased so as to lower the density of the colloidal silica that is the polishing agent when the polishing rate is too high. Alternatively, control may be performed to reduce the amplitude of vibration by decreasing the application degree of the ultrasonic processing (for example, by lowering or switching off an output of an ultrasonic oscillator, etc.) when the vibration is too strong. Preferably, in order to deal with such circumstances, it is preferable to record changes in the surface being polished in advance in a pilot polishing (in other words, preliminary polishing). The pilot polishing may be performed by varying the conditions (for example, temperature, type of polishing agent, type of polishing cloth, pressure, sliding speed, etc.) so as to associate them with the polishing rate, vibration, etc.

The semiconductor wafer polishing method according to the aforementioned embodiments may be characterized in that the ultrasonic processing is applied in the diluting step to the diluted slurry that is diluted at the predetermined proportion.

The semiconductor wafer polishing method according to the aforementioned embodiments may be characterized in that the aggregation preventing agent includes one or more compounds selected from the group consisting of ammonia, ammonium hydrogen carbonate (or ammonium bicarbonate), potassium hydroxide, and sodium hydroxide.

Here, the aggregation preventing agent may function as a pH stabilizer. As the pH stabilizer, KOH or NaOH may be employed as well as ammonia or ammonium bicarbonate.

The semiconductor wafer polishing method according to the aforementioned embodiments may be characterized in that the aggregation preventing agent includes a polarized molecule.

Here, the polarized molecule may be adopted as the aggregation preventing agent. As the polarized molecule, not only an alcohol, but also ammonia water, a sugar, or an ether can be adopted. For example, methanol may be included in the alcohol as the polarized molecule.

The semiconductor wafer polishing method according to the aforementioned embodiments may be characterized in that the aggregation preventing agent includes at least one salt constituted of a combination of a cation selected from a group consisting of $Li^+$, $Na^+$, $K^+$, $Mg^{2+}$, $Ca^{2+}$, and $NH_4^+$ and an anion selected from a group consisting of $CO_3^{2-}$, $Cl^-$, $SO_4^{2-}$, $F^-$, $NO_3^-$, $PO_4^{3-}$, $CH_3COO^-$, and $OH^-$.

Here, a salt may be adopted as the aggregation preventing agent. As the salt, not only calcium chloride or potassium chloride, but also any salt constituted of a combination of a cation selected from a group consisting of $Li^+$, $Na^+$, $K^+$, $Mg^{2+}$, $Ca^{2+}$, and $NH_4^+$ and an anion selected from a group consisting of $CO_3^{2-}$, $Cl^-$, $SO_4^{2-}$, $S^{2-}$, $F^-$, $NO_3^-$, $PO_4^{3-}$, $CH_3COO^-$, and $OH^-$ can be adopted.

The semiconductor wafer polishing method according to the aforementioned embodiments may be characterized in that the predetermined proportion of dilution can increase as time passes.

The semiconductor wafer polishing method according to the aforementioned embodiments may be characterized in that the ultrasonic processing applied to the diluted slurry is stopped in the diluting step.

Here, to stop the ultrasonic processing may mean that the diluted slurry to which the ultrasonic processing has not been applied is supplied while the polishing of the semiconductor wafer is being conducted (including "along with the progress of polishing" and "in the middle of one or more polishing steps"). For example, while the polishing of the semiconductor wafer is being conducted, the ultrasonic processing may be stopped with an apparatus that supplies the diluted slurry immediately after applying the ultrasonic processing to the diluted slurry. As described above, the slurry diluting step may be performed in parallel to the polishing of the semiconductor wafer. Therefore, the time lag from the diluting step to the supplying step in which the diluted slurry is actually supplied may be allowed to exist, and the diluted slurry to actually be supplied may be switched from what has undergone the ultrasonic processing to what has not while the polishing of the semiconductor wafer is being conducted. That is, when the time lag is long, the diluted slurry may actually be subject to the ultrasonic processing even before the polishing of the semiconductor wafer. The feedback control tends to be difficult when the time lag is long. Also the diluted slurry having been supplied may be held (or retained) in the middle of a supply path such that waste of thus-held slurry tends to occur, and it is preferable to contrive the path to minimize the amount of the held diluted slurry.

In an embodiment of the present application, a diluted slurry supplying apparatus, to be used in a polishing apparatus for finishing a semiconductor wafer with a slurry containing colloidal silica and water-soluble polymer, may be provided. The slurry supplying apparatus may comprise: a slurry supplying device capable of supplying an original slurry containing colloidal silica and water-soluble polymer; a diluent supplying device capable of supplying a diluent for diluting the original slurry; a mixer (or mixing container) capable of receiving the original slurry and the diluent supplied from the slurry supplying device and the diluent supplying device, respectively; and an ultrasonic processing device capable of applying ultrasonic vibration to the diluted slurry held inside the mixer or fed out from the mixer. Here, the mixer mixes the original slurry and the diluent to form the diluted slurry with a pH equal to or greater than 9. The diluent supplying device can vary a proportion of dilution in the diluted slurry by adjusting a flow rate of the diluent. And the diluent contains an aggregation preventing agent.

The slurry supplying apparatus according to the aforementioned embodiments may be characterized in that the aggregation preventing agent includes one or more compounds selected from the group consisting of ammonia, ammonium hydrogen carbonate (or ammonium bicarbonate), potassium hydroxide, and sodium hydroxide.

The slurry supplying apparatus according to the aforementioned embodiments may be characterized in that the aggregation preventing agent includes a polarized molecule.

The slurry supplying apparatus according to the aforementioned embodiments may be characterized in that the aggregation preventing agent includes at least one salt constituted of a combination of a cation selected from a group consisting of $Li^+$, $Na^+$, $K^+$, $Mg^{2+}$, $Ca^{2+}$, and $NH_4^+$ and an anion selected from a group consisting of $CO_3^{2-}$, $Cl^-$, $SO_4^{2-}$, $S^{2-}$, $F^-$, $NO_3^-$, $PO_4^{3-}$, $CH_3COO^-$, and $OH^-$.

As described above, the aggregation of the colloidal silica can be prevented effectively and the polishing characteristics of the diluted slurry can be maintained if the slurry containing the colloidal silica is used upon being diluted with water containing the aggregation preventing agent. Also, the polishing characteristics of the slurry containing the colloidal silica can be optimized by varying the dilution rate of the diluted slurry during the polishing step.

The above is merely an example, and an optimal polishing environment can be created so as to suit the polishing quality according to the object being polished by using various factors to vary the properties of the supplied slurry. Besides the factors mentioned above, the type and concentration of the aqueous polymer in the slurry, the type and density of the colloidal silica, the temperature, the supply amount of the slurry, etc., can be cited as examples of such factors. These factors may be arranged in a database based on various experiments to design an appropriate polishing environment.

What is claimed is:

1. A polishing method for finishing a semiconductor wafer with a slurry comprising colloidal silica and water-soluble polymer, the method comprising:

diluting the slurry at a predetermined proportion with ammonia water while an ultrasonic processing is applied to the diluted slurry; and supplying the diluted slurry in an initial stage of polishing wherein:

the diluted slurry comprises a pH value of at least 9;

diluting the slurry with ammonia water while the ultrasonic processing is stopped;

supplying the diluted slurry in an intermediate stage of polishing;

diluting the slurry with water while the ultrasonic processing is stopped; and supplying the diluted slurry in a final stage of polishing.

2. The polishing method according to claim 1 wherein the aggregation preventing agent includes at least one salt constituted of a combination of a cation selected from a group consisting of $Li^+$, $Na^+$, $K^+$, $Me^{2+}$, $Ca^{2+}$, and $NH^{4+}$ and an anion selected from a group consisting of $CO_3^{2-}$, $Cl^-$, $SO_4^{2-}$, $S^{2-}$, $F^-$, $NO_3^-$, $PO_4^{3-}$, $CH_3COO^-$, and $OH^-$.

3. The polishing method according to claim 1 wherein the predetermined proportion of the diluent increases with elapse of time.

4. A polishing method for finishing a semiconductor wafer with a slurry comprising colloidal silica and water-soluble polymer, the method comprising:

diluting the slurry at a predetermined proportion with a diluent while an ultrasonic processing is applied to the diluted slurry;

supplying the diluted slurry in an initial stage of polishing;

wherein:

the diluent comprises KCl and has a colloidal density lower than that of the slurry, the diluted slurry comprises a pH value of at least 9;

diluting the slurry with the diluent while the ultrasonic processing is stopped;

supplying the diluted slurry in an intermediate stage of polishing;

diluting the slurry with water while the ultrasonic processing is stopped; and supplying the diluted slurry in a final stage of polishing.

5. The polishing method according to claim 4 wherein the diluted slurry comprises a pH value of 9 to 10.1.

* * * * *

UNITED STATES PATENT AND TRADEMARK OFFICE

CERTIFICATE OF CORRECTION

PATENT NO. : 8,303,373 B2
APPLICATION NO. : 12/471102
DATED : November 6, 2012
INVENTOR(S) : Kozasa It is certified that error appears in the above-identified patent and that said Letters Patent is hereby corrected as shown below:

In the Specifications:

Column 10
Line 22, "10" should read --110--

In the Claims:

Column 17
Line 33, before "$F^-$" insert --$S2^-$--

Column 19
Line 13, "$Me^{2+}$" should read --$Mg^{2+}$--

Signed and Sealed this
Thirtieth Day of April, 2013

Teresa Stanek Rea
*Acting Director of the United States Patent and Trademark Office*